United States Patent [19]

Lewthwaite

[11] 3,977,281

[45] Aug. 31, 1976

[54] APPARATUS FOR PUNCHING HOLES

[76] Inventor: Herbert H. Lewthwaite, 73 Buff Road, Tenafly, N.J. 07670

[22] Filed: Sept. 11, 1975

[21] Appl. No.: 612,588

[52] U.S. Cl. ..... 83/138; 83/387; 83/395; 83/522; 83/916

[51] Int. Cl.[2] ..... B26D 7/16; B26D 7/18

[58] Field of Search ..... 83/139, 140, 138, 395, 83/, 387, 522, 916

[56] References Cited

UNITED STATES PATENTS

| | | | |
|---|---|---|---|
| 868,428 | 10/1907 | Grossman | 83/138 |
| 1,914,313 | 6/1933 | Wales | 83/140 |
| 3,368,436 | 2/1968 | Weisbeck | 83/140 |

*Primary Examiner*—Donald R. Schran
*Attorney, Agent, or Firm*—Brumbaugh, Graves, Donohue & Raymond

[57] ABSTRACT

A hole punching apparatus in which a punch having a center point formed thereon is locked to a punch support by in-line locking pins which can be unlocked to move the punch independently of its support toward the stock to be punched to align the center point of the punch and the location point on the stock, and in which cam means is provided for camming the locking means to release position when the punch is moved toward its original position relative to the punch support, means is provided for automatically restoring the locking pins to locked positions when the punch is restored to its original position and a telescoping connection is provided between the punch and the punch support for maintaining them in alignment when the punch is moved relative to the punch support to bring the center point of the punch into engagement with the stock.

8 Claims, 5 Drawing Figures

FIG. 3
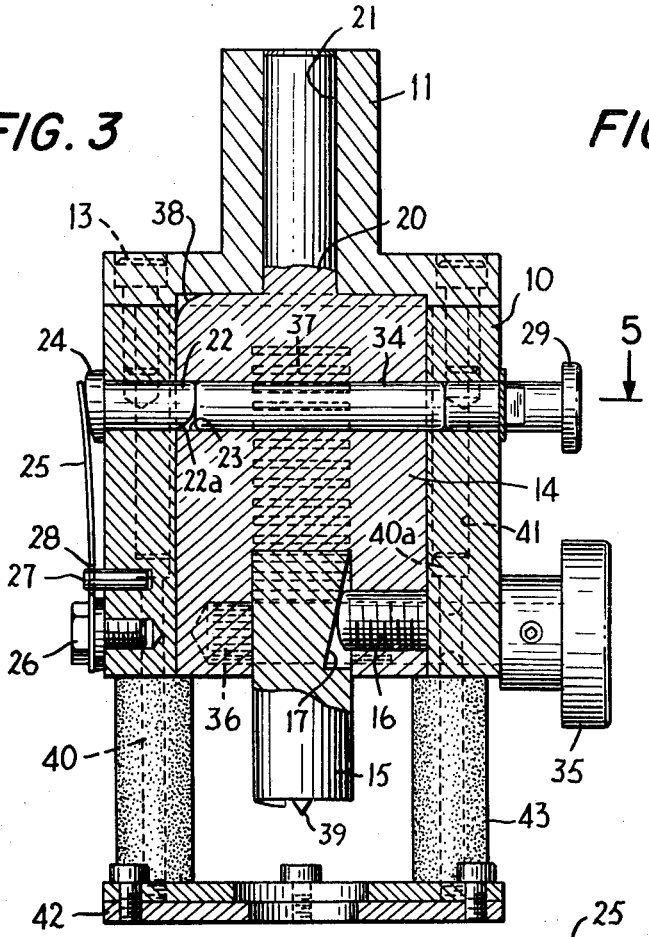
FIG. 4
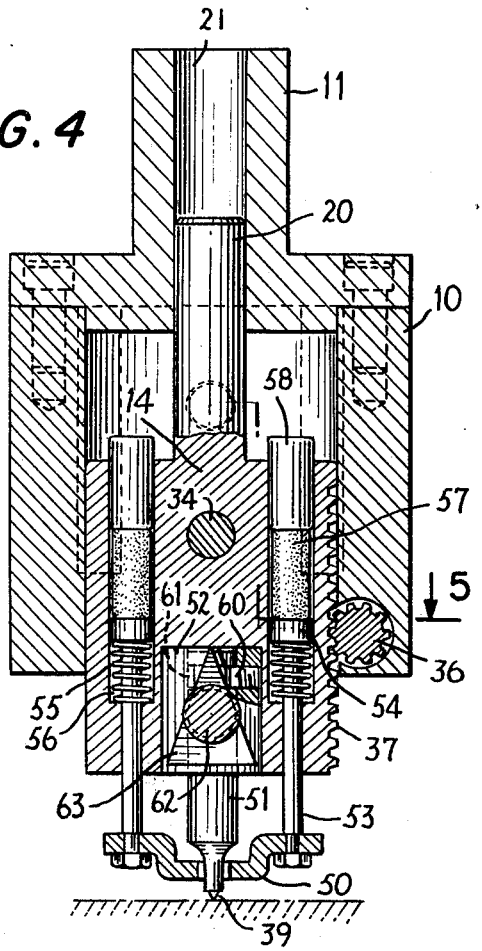
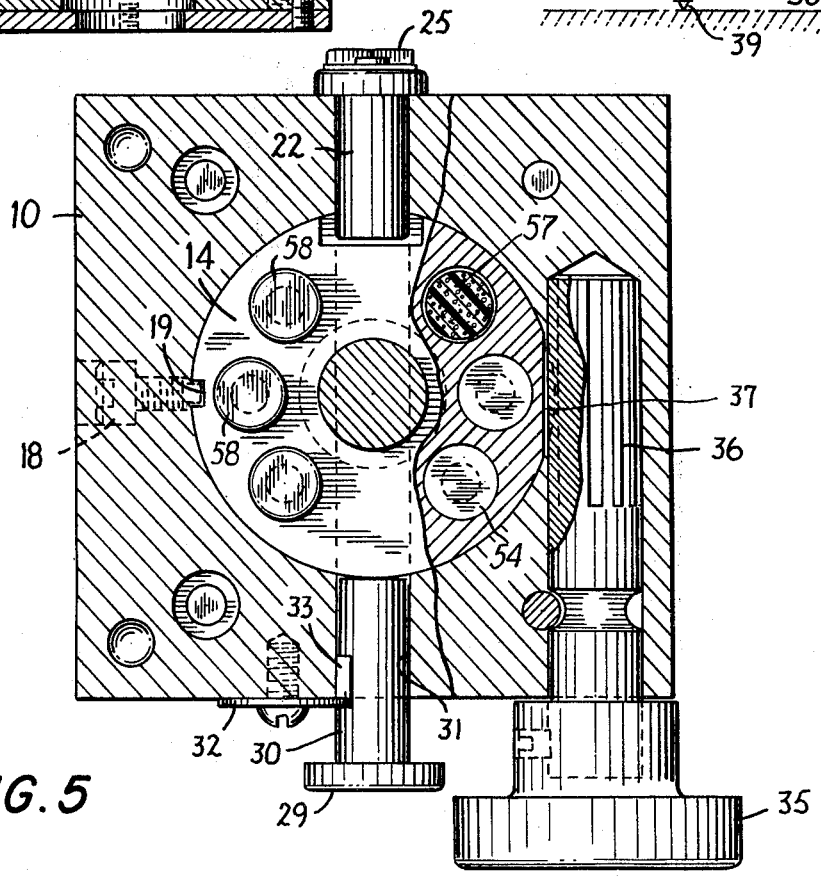
FIG. 5

APPARATUS FOR PUNCHING HOLES

This invention relates to hole punching apparatus, and more particularly, to hole punching apparatus of the type described in U.S. Pat. No. 2,798,553, issued July 9, 1957, to David Berdan.

In the mass production of sheet metal articles where holes of various sizes are to be formed by a punching operation, it is common to provide locating gauges, stops, positioning fingers, pins and the like in order to assure punching of the holes accurately therein. Such locating apparatus is useful for production on a large scale but is not very practical when only a few articles are to be made, for example, in prototype work or template making.

The present invention relates to a hole punching apparatus in which the punch carries a center point and is adjustable relative to a punch support to enable the operator to align the center points of the punch and the stock to be punched.

The present invention provides, inter alia, a novel locking and releasing means for the punch, means for maintaining the alignment of the punch and punch support when the punch is moved relatively to the punch support, and means for stripping the stock from the punch after the punching operation.

For a more complete understanding of the present invention, reference may be made to the accompanying drawings, in which:

FIG. 3 is a cross-sectional elevational view of the apparatus taken along the line 3—3 of FIG. 2 looking in the direction of the arrows;

FIG. 4 is a cross-sectional elevational view of another embodiment of the invention; and FIG. 5 is a cross-sectional view of the apparatus shown in FIG. 4 taken along the line 5—5 looking in the direction of the arrows.

Figure 1:
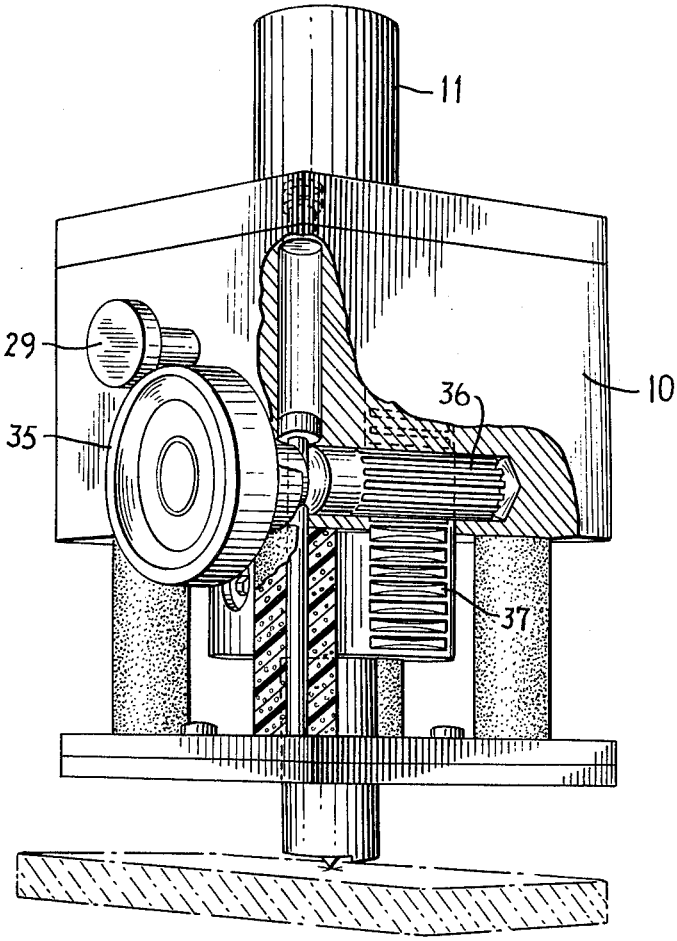
FIG. 1 is an isometric view, partially broken away, of a typical form of apparatus embodying the present inventon.
Figure 2:
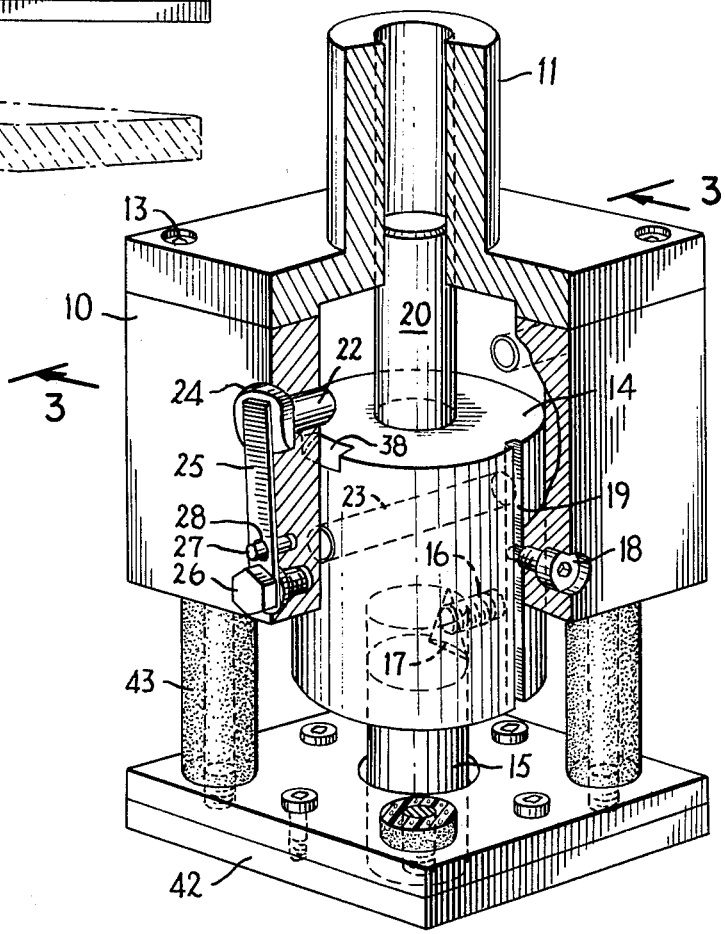
FIG. 2 is an isometric view, partially broken away, of the apparatus shown in FIG. 1 viewed from the opposite direction.

A typical apparatus embodying the present invention is illustrated in FIGS. 1 through 3 of the drawings. The apparatus includes a punch holder body 10 depending from a shank 11 which is adapted to be mounted in a reciprocating plunger of a punch press. The punch holder body 10 is secured to the shank 11 by screws 13.

The punch holder body 10 accommodates therein a punch holder slide 14 which carries a punch 15 depending therefrom. The upper end of the punch 15 is accommodated within a recess formed in the bottom of the punch slide, and the punch is locked to the punch slide by a screw 16 which engages a beveled surface 17 recessed in the side of the punch. The punch slide 14 is guided for movement within the punch holder body 10 by the engagement of the inner end of a screw 18 with a slot or groove 19 which extends longitudinally of the punch slide. The engagement of the screw 18 with the slot or groove 19 prevents rotation of the punch slide within the punch holder body.

The upper end of the punch slide is connected with the shank by a telescoping connection which includes a guide rod 20 extending upwardly from the top of the punch slide and a guide hole 21 formed within the shank 11. The telescoping connection maintains the punch holder properly aligned within the punch holder body.

The punch slide can be locked in a raised position within the punch holder body by the engagement of a locking pin 22 with the end of a borehole 23 which extends through the punch slide. The locking pin 22 passes through an opening in a wall of the punch holder body and has a head 24 formed on the outside thereof. A leaf spring 25 engages the head of the locking pin and urges it into locking engagement with the punch holder body. The leaf spring is mounted to the wall of the punch holder body by a screw 26, and the upper leaf spring is maintained in proper alignment with the head of the locking pin by the engagement of a pin 27 extending outwardly from the wall of the punch holder body with a hole 28 in the leaf spring intermediate the mounting screw 26 and the upper end of the leaf spring.

The locking pin 22 can be moved to release position by depressing a pushbutton 29 mounted for movement in the opposite wall of the punch holder body. The pushbutton is formed on the end of a rod 30 which is axially movable within an opening 31 in the punch holder body. The movement of the rod 30 is limited by the engagement of a stop 32 which engages a recess 33 formed in the rod 30. The borehole 23 through the punch slide accommodates a locking pin 34 therein which is intermediate the inner ends of the locking pin 22 and the rod 30. The locking pin 22 is released by depressing the button 29 and displacing the intermediate locking pin 34 to a position such that the end adjacent the rod 30 is displaced from the opening 31 and the locking pin 22 is displaced from the borehole 23. When the punch slide is released, the punch slide and the punch carried thereby can be moved vertically relative to the punch holder body.

The slide and the punch carried thereby are moved relative to the punch holder body by the rotation of a knob 35. The knob 35 is mounted at the end of a pinion 36 which is journaled for rotation in the punch holder body. The pinion 36 meshes with the teeth of a rack 37 formed on the punch slide.

The punch 15 has a pointed formation 39 depending from the lower end. This pointed formation is located at the center point of the punch. When the punch slide is released by unlocking the locking pins 22, 34, the punch slide and punch can be moved relative to the punch holder body to bring the center point into contact with the stock to be punched. The center point will mark the center of the punch and, by comparing the mark imposed on the stock by the center point, the operator can determine whether the stock is properly positioned relative to the punch.

When the operator has properly oriented the stock relative to the punch, the reciprocating plunger of the punch can be operated to move the punch into punching engagement with the stock or the punch can be manually raised to its normal locked position within the punch holder body before the punching operation. In either case, the punch slide will be restored to is original position and automatically locked in the punch holder. To facilitate this, an edge 38 of the punch slide is sloped and acts against a sloped edge **22*a* of the locking pin to cam the locking pin to release position. When the punch slide is raised to its normal operative position within the punch holder body, the locking pin 22 reengages the end of the passage 23 under the influence of the spring 25 and displaces the locking pin 34 so that it, in turn, moves into locking engagement with the hole 31, thereby displacing the button 29** to its outermost position.

The punching apparatus of the present invention includes means for stripping the stock from the punch after the punching operation. The stripping means includes a plurality of pins 40 which are vertically slidable in bores 41 formed in the punch holder body. The bores are counterbored at their upper ends to receive the enlarged heads 40*a* at the upper ends of the pins, and the bores limit the downward movement of the pins. The pins carry a stripper plate 42 at the lower ends thereof, and resilient springs 43, shown in the form of polyurethane sleeves, are supported on the pins intermediate the stripper plate and the lower end of the punch holder body to exert a downward force on the stripper plate. Thus, when the punch is moved into punching engagement with the stock, the stripper plate engages the stock before the punch and the compression of the springs 43 permits the pins 40 to move upwardly relative to the punch holder body to permit the punch to move into punching engagement with the stock. During the upward movement of the punch holder body, the punch is lifted and the expansion of the springs 43 causes the stripper plate to strip the stock from the punch.

In the alternative embodiment of the invention shown in FIGS. 4 and 5, a stripper plate 50 is carried by the punch slide 14 and a punch 51 is mounted in the slide 14 within an adapter 52 to permit smaller sizes of punches to be mounted to the punch slide.

The stripper plate 50 is supported on the ends of pins 53 having enlarged heads 54 which are guided in boreholes 55. The boreholes accommodate springs 56 which tend to urge the pins 53 upwardly. Resilient springs 57 made of steel or polyurethane are accommodated within boreholes 55 above the heads of the pins, and pins 58 are accommodated within the boreholes above the springs 57.

In this embodiment, when the punch slide is unlocked and the punch is moved into engagement with the stock to effect the alignment between the center points of the punch and the stock, the compressed springs 55 raise the stripper plate 50 relative to the lower end of the punch to make the lower end of the punch visible to the operator. When the punch slide 14 is raised to its normal operative locked position within the punch holder body, the upper ends of the pins 58 engage the punch holder body and move the stripper plate 50 to its operative position beneath the lower end of the punch.

In the operation of the punch, the stripper plate functions in the same manner as the stripper plate 42 described above, that is to say, it engages the stock in advance of the punch and, by reason of the compression of the springs 57, permits the punch to complete the punching operation. When the punch holder body is raised, the expansion of the springs 57 strips the stock from the end of the punch.

In the embodiment shown in FIGS. 4 and 5, the punch 51 is mounted in the adapter 52 by the engagement of a screw 60 with a recess 61 formed in the upper end of the punch. The adapter 52, in turn, is locked to the punch slide 14 by the engagement of a screw 62 threaded in the slide with an inclined or beveled surface 63 formed in the outer periphery of the adapter. This arrangement permits smaller size punches to be mounted to the punch slide.

In the preferred mode of operation of the punching apparatus, the metal stock to be punched has a location point marked thereon to indicate the center of the hole to be punched therein. The stock is placed on the female die which is mounted on the punch press table below the punch holder body, the locking pins 22 and 34 are released by the depression of the botton 29 and the knob 35 is turned to move the punch assembly toward the stock. The stock is adjusted relative to the punch until the location point is directly below the center point 39 of the punch. When alignment has been achieved by lowering the punch to engage the stock the punch press is actuated to move the punch holder body downwardly. The punch slide 14 and the punch mounted therein remain stationary, but the relative movement between the punch holder body and the punch slide restores the slide to its original position within the punch holder body. During this restoration, the upward movement of the slide relative to the punch holder body imparts rotation to the knob 35 and the cammed surfaces 22*a* and 38 move the locking pin 22 out of the path of the slide. When the punch holder body engages the upper end of the slide, the continued movement of the punch holder body drives the punch through the stock. Also, when the slide is restored to its original position in the punch holder body, the locking pin is spring-urged into locking engagement with the end of the borehole 23 and the locking pin 34 is displaced to its locking position within the hole 31.

When the punch press raises the punch holder body, the stripper plates 42, 50 are spring-urged against the stock and strip it from the punch. The punching apparatus is then ready for another punching operation.

The invention has been shown and described in its preferred forms and by way of example only. The invention is not intended to be limited to any particular form or embodiment except insofar as such limitations are expressly set forth in the claims.

I claim:

1. In an apparatus for accurately locating and punching holes in stock comprising a punch support, a punch carried by the support and adjustable relative to the support from a punching position to a position for checking the position of the punch relative to the stock, a center point carried by the punch and movable with the punch into engagement with the stock to compare the center points of the punch and the stock before the punching operation to give the operator a visual indication of the location of the center point of the punch relative to the stock, and a telescoping connection between the punch and the punch support for maintaining them in alignment when the punch is moved relative to the stock to bring the center point into engagement with the stock.

2. An apparatus for accurately locating and punching holes in stock as set forth in claim 1 including means for locking the punch in punching position relative to the punch support, means for releasing the lock to move the punch independently of the punch support toward and away from the stock, and cam means cooperating between the punch and the punch support for camming the locking means to a release position when the punch is restored to its normal punching position relative to the punch support, the locking means automatically locking the punch when it is restored to punching position relative to the punch support.

3. An apparatus for accurately locating and punching holes in stock as set forth in claim 1 including means for locking the punch to the punch support which includes a locking pin for locking the punch to the punch support, means urging the locking pin to locking position, means carried by the punch support for releasing the pin and an intermediate locking connection between the locking pin and the release means for transmitting the motion from the release means to the pin, said intermediate connection being movable within the punch relative to the punch support.

4. An apparatus for accurately locating and punching holes in stock as set forth in claim 1 including stripping means carried by and relatively movable with respect to the punch, means cooperating between the punch and the punch support for lowering the stripping means to a level below the end of the punch when in normal operation position relative to the punch support, said means including resilient means for permitting the stripping means to move relative to the punch when the stripping means engages the stock, and means to raise the stripping means above the lower end of the punch when the punch is lowered relative to the punch support to make the lower end and center point of the punch visible to the operator.

5. In an apparatus for accurately locating and punching holes in stock comprising a punch support, a punch carried by the support and adjustable relative to the support from a punching position to a position of effecting the position of the punch relative to the stock, a center point carried by the punch and movable with the punch into engagement with the stock to compare the center points of the punch and the stock before the punching operation to give the operator a visual indication of the location of the center point of the punch relative to the stock, means for locking the punch in punching position relative to the punch support, means for releasing the lock to move the punch independently of the punch support toward and away from the stock, and cam means cooperating between the punch and the punch support for camming the locking means to release position when the punch is restored to its normal punching position relative to the punch support, the locking means automatically locking the punch when it is restored to punching position relative to the punch support.

6. An apparatus for punching holes in stock as set forth in claim 5 including a telescoping connection between the punch and the punch support for maintaining them in alignment when the punch is moved relative to the stock to bring the center point into engagement with the stock.

7. An apparatus for punching holes in stock as set forth in claim 5 in which the locking means includes a locking pin for locking the punch to the punch support, means urging the locking pin to locking position, and an intermediate locking connection between the locking pin and the release means for translating the motion from the release means to the pin, said intermediate connection being movable within the punch relative to the punch support.

8. An apparatus for punching holes in stock as set forth in claim 5 including stripping means carried by and relatively movable with respect to the punch, means cooperating between the punch and the punch support for locating the stripping means at a level below the punch when the punch is in its normal operative position relative to the punch support, said means including resilient means for permitting the stripping means to move relative to the punch when the stripping means engages the stock, and means to raise the stripping means above the lower end of the punch when the punch is moved relative to the punch support to make the lower end and center point of the punch visible to the operator.

* * * * *